US007954598B2

(12) United States Patent
Wallther

(10) Patent No.: US 7,954,598 B2
(45) Date of Patent: Jun. 7, 2011

(54) DEVICE FOR HUMAN PROTECTION IN SCAFFOLDING

(75) Inventor: Harry Wallther, Hindås (SE)

(73) Assignee: PlusEight Safety AB (SE)

( * ) Notice: Subject to any disclaimer, the term of this patent is extended or adjusted under 35 U.S.C. 154(b) by 76 days.

(21) Appl. No.: 10/473,638

(22) PCT Filed: Feb. 13, 2002

(86) PCT No.: PCT/SE02/00240

§ 371 (c)(1),
(2), (4) Date: Apr. 12, 2004

(87) PCT Pub. No.: WO02/077392

PCT Pub. Date: Oct. 3, 2002

(65) Prior Publication Data

US 2004/0163889 A1 Aug. 26, 2004

(30) Foreign Application Priority Data

Mar. 27, 2001 (SE) ..... 0101069

(51) Int. Cl.
*E04G 5/00* (2006.01)

(52) U.S. Cl. ..... 182/113

(58) Field of Classification Search ..... 182/113, 182/178.1, 179.1, 186.7, 186.8
See application file for complete search history.

(56) References Cited

U.S. PATENT DOCUMENTS

| | | | | | |
|---|---|---|---|---|---|
| 354,880 | A | * | 12/1886 | Amon | 256/21 |
| 944,373 | A | | 12/1909 | Muller | |
| 2,060,171 | A | | 11/1936 | Burton | |
| 2,240,864 | A | | 5/1941 | Segre | |
| 2,332,477 | A | * | 10/1943 | Thornley | 182/87 |
| 2,674,476 | A | | 4/1954 | Grosso | |
| 2,751,258 | A | | 6/1956 | Brattland | |
| 2,805,103 | A | * | 9/1957 | Jovais | 182/60 |
| 2,853,324 | A | | 9/1958 | Neidmann | |
| 3,480,242 | A | * | 11/1969 | Cleveland | 248/231.71 |
| 3,756,568 | A | * | 9/1973 | Mocny et al. | 256/59 |
| 3,863,899 | A | * | 2/1975 | Werner | 256/24 |
| 3,881,698 | A | * | 5/1975 | Marsh | 256/59 |

(Continued)

FOREIGN PATENT DOCUMENTS

CA 1194059 A1 9/1985

(Continued)

OTHER PUBLICATIONS

Office Action from Polish Patent Application No. P-363993 dated Oct. 20, 2010.

*Primary Examiner* — Alvin C Chin-Shue
(74) *Attorney, Agent, or Firm* — Lerner, David, Littenberg, Krumholz & Mentlik, LLP

(57) ABSTRACT

The present invention relates to a device for personal protection at such scaffolds that consist of scaffold posts (5, 6) and lying scaffold elements (7, 8, 15), coupled between the posts. The protective device consists of two protective post (26, 27) and a protective rail (32) with a variable length that extends between the protective posts. The protective rail is equipped with joint devices in their ends for a joined connection between the protective posts. The protective posts are equipped with coupling devices (28-31) for releasable connection with the scaffold. Thus the protective posts and the associated protective rail may gradually be moved between different vertical positions due to the need for protection.

15 Claims, 7 Drawing Sheets

U.S. PATENT DOCUMENTS

| | | | | |
|---|---|---|---|---|
| 4,039,264 | A | 8/1977 | Sharp et al. | |
| 4,095,910 | A | 6/1978 | Steele et al. | |
| 4,273,463 | A | 6/1981 | Dobersch et al. | |
| 4,405,254 | A | 9/1983 | Tooley et al. | |
| 4,439,052 | A | 3/1984 | Wallther et al. | |
| 4,586,842 | A | 5/1986 | Puccinelli | |
| 4,805,735 | A | 2/1989 | Anderson | |
| 5,078,532 | A | 1/1992 | Williams | |
| 5,127,757 | A | 7/1992 | Langer et al. | |
| 5,186,568 | A | 2/1993 | Falardeau et al. | |
| 5,207,527 | A | 5/1993 | Duncan et al. | |
| 5,217,314 | A | 6/1993 | Perruelle et al. | |
| 5,615,966 | A | 4/1997 | Jarvis et al. | |
| 5,829,550 | A | 11/1998 | Cornish | |
| 5,961,240 | A | 10/1999 | Bobrovniczky et al. | |
| 5,988,318 | A | 11/1999 | Krause et al. | |
| 6,006,862 | A * | 12/1999 | Palmer | 182/113 |
| 6,027,276 | A | 2/2000 | Schworer et al. | |
| 6,220,392 | B1 | 4/2001 | Schwoerer et al. | |
| 6,279,880 | B1 * | 8/2001 | Hawks, Jr. | 256/67 |
| 7,048,093 | B2 | 5/2006 | Wallther et al. | |
| 2002/0053486 | A1 * | 5/2002 | Galdos Urzelai | 182/113 |
| 2002/0100636 | A1 * | 8/2002 | Cole | 182/113 |
| 2002/0179370 | A1 * | 12/2002 | Ono | 182/113 |
| 2003/0047382 | A1 * | 3/2003 | Panacci | 182/113 |

FOREIGN PATENT DOCUMENTS

| | | | |
|---|---|---|---|
| CH | 660 617 | A1 | 5/1987 |
| DE | 33 45 645 | A1 | 7/1985 |
| DE | 42 42 031 | A1 | 6/1994 |
| DE | 196 33 092 | A1 | 2/1998 |
| DE | 298 08 393 | A1 | 10/1998 |
| DE | 299 02 904 | A1 | 6/1999 |
| EP | 0 142 419 | A2 | 5/1985 |
| EP | 0 728 884 | A1 | 8/1996 |
| EP | 0995860 | A1 | 4/2000 |
| FR | 2 680 196 | A1 | 2/1993 |
| FR | 2 732 706 | A1 | 10/1996 |
| GB | 1 528 220 | A1 | 10/1978 |
| GB | 2056545 | A | 3/1981 |
| JP | 02285146 | A * | 11/1990 |
| SE | 7908679-9 | B1 | 5/1982 |

* cited by examiner

DEVICE FOR HUMAN PROTECTION IN SCAFFOLDING

TECHNICAL FIELD

The present invention relates to a device for personal protection at such scaffolds that consist of scaffold posts and lying scaffold elements, arranged to be coupled between the posts, where the protective device at least consists of two protective posts and at least one protective rail that extends between the protective posts, that the ends of the protective rail are equipped with connecting devices for connection to the protective posts, that every protective post is equipped with at least one coupling device for releasable connection with the scaffold posts, where the protective posts and the associated protective rail gradually may be moved between different vertical positions according to the need for protection where the protective device comprises maneuvering means for shifting the coupling devices between a releasing position and a coupling position.

BACKGROUND ART

At premounted scaffolds there is a personal protection against fall in the form permanent protective rails which are coupled between the scaffold posts in a scaffold. At the same time, these also constitute stabilizing parts in the scaffold and keep the scaffold posts in an upright position.

During mounting and dismounting of scaffolds, the scaffold workers often work at those parts of the scaffolds that lacks protective rails. In order to protect against fall, protective harnesses with lifelines are used which, however, limit the person's liberty of action. Secure abutment points have to be chosen and moved as the work proceeds.

DISCLOSURE OF INVENTION

The purpose of the present invention is to present a device which replaces or supplements security harnesses and which also is easy to handle.

Said purpose is achieved by means of the device according to the present invention, which is characterized in that said maneuvering devices are arranged in at least one end of each protective post.

BRIEF DESCRIPTION OF DRAWINGS

The invention will in the following be described more in detail with a couple of embodiment examples with reference to the enclosed drawings where.

PREFERRED EMBODIMENT

Figure 1:
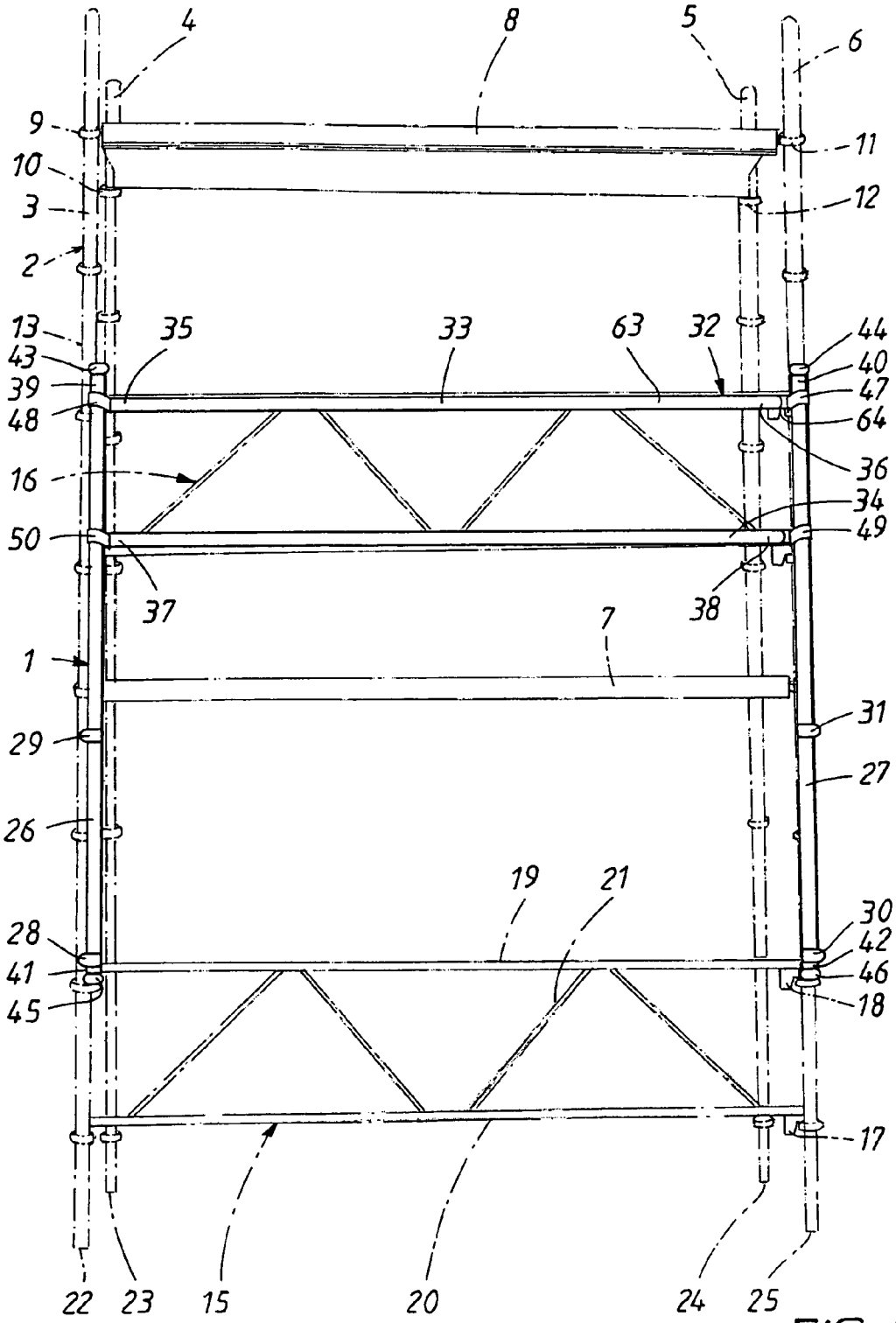
FIG. 1 shows a first embodiment of the invention in a front view, mounted in a position on a scaffold.

FIG. 1 discloses the principle construction of a protective device 1 for personal protection at scaffolds 2. The protective device 1 is shown with somewhat bolder lines, while the scaffold is shown with somewhat thinner lines for making the protective device more clear.

A number of scaffold posts belong to the scaffold, in the example shown according to FIG. 1 four posts 3, 4, 5, 6, which in pairs carry work platforms 7, 8 which constitute a number of floors, in the example shown two floors, in order to enable work at different heights along, for example, the front of a house building. The platforms are carried between the posts which are arranged in pairs by, for example being equipped with hooks, see FIG. 5, which are directly coupled to fixed coupling attachments 9, 10, 11, 12 which are arranged with certain distances along the length of the posts. The coupling attachments may for example consist of upwards open bowls or cups which are shown in the Swedish patent application number 0101069-3. Alternatively, between the posts 3 and 4 respective 5 and 6 lateral, lying, preferable horizontal scaffold elements may extend which are hooked in the cups 9, 10 respective 11 and 12. The cups are arranged in groups of four at the same height, where the platforms 7, 8 are equipped with hooks which are hooked in the lying scaffold elements and are thus carried directly by these.

The fixed coupling attachments 9, 10, 11, 12, i.e., the cups, are undisplaceably and unturnably arranged at the mantle surface 13 of respective posts. Each post is preferably divided into several sections which are joined in each other longitudinally as a certain height shall be achieved for the scaffold.

In the scaffold there are also permanent scaffold rails, two of these are shown in FIG. 1. These are thus arranged such that each scaffold rail 15, 16 is arranged between the two outermost posts 3 and 6 in order to form a protection outwards, for example at a suitable height above a work platform 7. Each scaffold rail 15, 16 is equipped with four hook-shaped coupling parts 17, 18 which are intended to be hooked in four of the fixed coupling attachments of the posts 3, 6. The scaffold rails are in the example shown equipped with a hand rail 19, a dormer 20 and an intermediate stay 21. Together with the work platforms 7, 8 and any laterally lying scaffold elements, the scaffold rails 15, 16 form a part of the supporting construction of the scaffold. As disclosed in FIG. 5, the scaffold rails are also arranged on the gable sides of the scaffold.

The mounting of the scaffold starts from below, since the posts, 3-6 with their lower ends 22-25 shall rest against a foundation, for example the ground or floor. The mounting starts by keeping the lower section of at least two posts, for example 3 and 6, in an upright position, standing on the foundation, after which a connecting element is mounted, in the example according to FIG. 1 the scaffold rail 15 and work platform 7, where at least the lower sections of the four posts are kept upright. During continued mounting above the work platform 7, one has attained a height that means a risk of accidents. For example, the scaffold shall have such a height that each post consists of several sections which are joined in each other, after which the scaffold rails 16 and work platforms 8 that are positioned above, shall be mounted.

In order to protect personnel during mounting and dismounting of the scaffold, the protective device 1 according to the invention has thus been achieved, which is arranged to be moved along upwards respective downwards as the scaffold is mounted respective dismounted. For this purpose, the protective device 1 consists of, see for example FIG. 1, at least two protective posts 26, 27, which each one is equipped with coupling devices 28, 29, 30, 31 for releasable connection with the scaffold posts 3 and 6. In the example shown, each protective post 26, 27 is equipped with two coupling devices 28-31 arranged at a distance from each other for a connection that assures that the protective posts extend mainly parallel with the scaffold posts. The protective posts 26, 27 carry between them at least one protective rail 32, that in the example shown consists of an overlying rail element 33 and an underlying rail element 34. Both rail elements 33, 34 are in their ends 35, 36, 37, 38 connected with the protective posts 26, 27, more in detail they are jointly connected with the protective posts, preferably in connection with the upper ends of the protective posts thus making the overlying rail element to be positioned close to the respective upper ends 39, 40 while the underlying rail element 34 is positioned a distance below, which distance is adapted for the current protective function.

Each one of the protective posts 26, 27 is equipped with maneuvering means 43, 44, 45, 46 in at least one end 39, 40, in the example shown both ends 3942, which maneuvering means are arranged for shifting the coupling devices 28-31 between a releasing position and a coupling position. In the coupling position, the coupling devices 28-31 are arranged to retain the protective posts 26, 27 in their parallel position, i.e. to prevent radial movements, that may in principle also be arranged to retain the chosen vertical position for the protective posts, i.e. lock relative axial movements for the posts. For this purpose, the protective posts or the coupling means may instead acquire support against bearing surfaces in the scaffold, such as the existing coupling attachments, more precisely the coupling cups 9-12 of the scaffold posts. In the example first shown, one of the coupling devices of the protective posts 26, 27 rests against the coupling cups 14 with an intermediate scaffold element.

Figure 2:
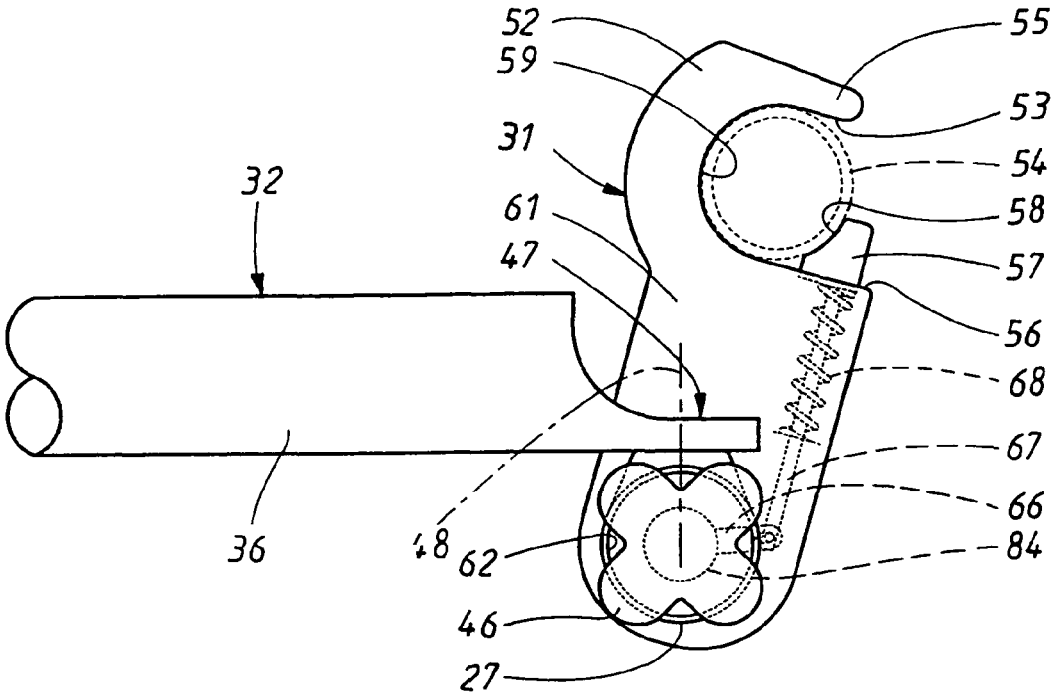
FIGS. 2 and 3 show a detailed view of the protective device according to the invention with a coupling device that forms a part of the protective device in a coupling position and a releasing position, respectively.
Figure 3:
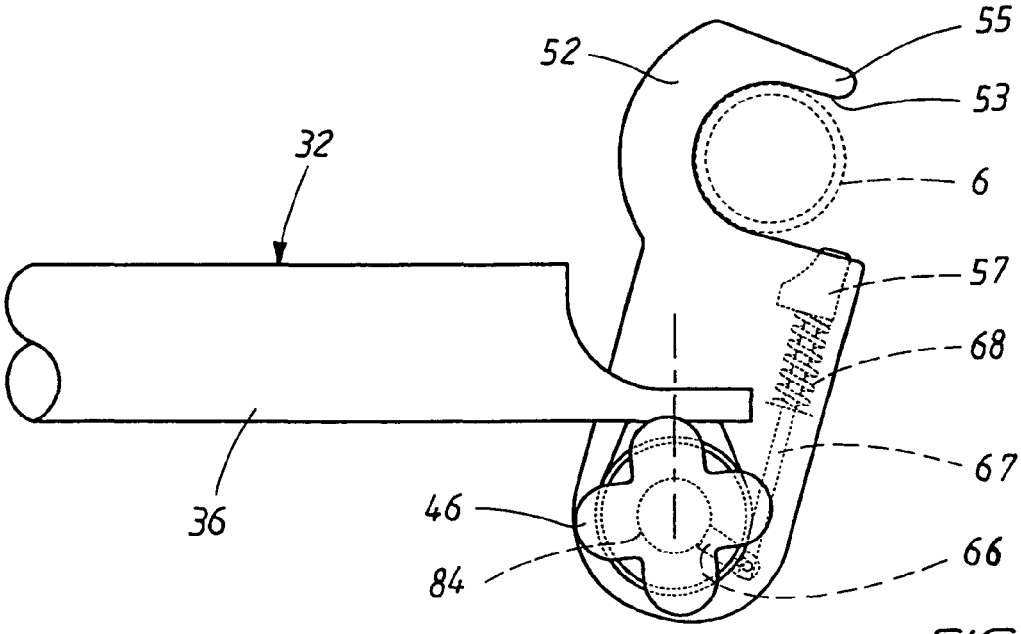

With the larger scaled detailed views according to FIGS. 2 and 3, one end 36 of the rail element 32 is shown jointly connected with the protective post 27 by means of an attachment device in the form of a joint device 47, that enables a relative joint movement of the rail element 32 around an axis that in FIGS. 2 and 3 is shown schematically as a geometrical axis 48 that mainly extends radially relative to the protective post 27. Via the joint device 47, the rail element 32 is thus carried in its end 36 by the protective post 27. In a corresponding way, the same rail element is carried in its other end via a corresponding attachment device in the form of a joint device 48 of the second protective post 26. The lower rail element 34 is also via an attachment device in the form of a joint device 50 movably or jointly connected with the protective post 26 in its end 37 and in its opposite end 38 connected with the protective post 27 via a fourth joint device 49. These may be firmly connected with the posts, but may alternatively be displaceable between different vertical positions along the posts and lockable to these in the chosen vertical position.

In FIGS. 2 and 3 one of the coupling devices 31 is also shown, which thus is axially positioned at a distance from the joint device 47, as disclosed in FIG. 1. In the example shown, the coupling device 31 consists of a grab hook 52 with a grab space 53 that is designed and dimensioned to receive a scaffold post 6 of the scaffold. A cross section of the scaffold post 6 is indicated with dashed lines. The grab space 53 is equipped with an opening 54, preferably turned in the direction from the rail element 32 and dimensioned with a distance between the hook end 55 and the opposite surface 56, exceeding the outer diameter of the scaffold stand. The coupling device 31 is equipped with a locking means 57 that is shiftable between a locking position for the coupling device, which is shown in FIG. 2, and a releasing position that is shown in FIG. 3. In the example shown, the locking means 57 consists of a locking bolt which is moveably mounted to the grab hook 52 and displaceable into the intermediate space 54 respective out of this. In locking position the effective intermediate space 54 shrinks to a dimension falling below the diameter of the scaffold post. The locking bolt is preferably designed with a locking surface 58 that together with the concave inner surface 59 of the grab hook 52 is adapted to provide a surface bearing and a stable support against the mantle surface 13 of the scaffold post which in the example shown is cylindrical. Thus the locking bolt is protrudable, for example by means of a spring mechanism 68 that is schematically shown, thus providing a bearing—without play between the supporting surfaces. In the releasing position according to FIG. 3, it is possible to withdraw the grab hook 52 of the coupling device 31 from the scaffold post 6, thus removing the grab hook from the coupling position and removing it from the scaffold post 6 in order to move it to a new protective position or dismounting, which will be described more in detail below.

In FIGS. 2 and 3, one of the maneuvering means 46 is schematically shown, more precisely the one that is positioned in the lower end 42 of the post 27. The maneuvering means 46 consists of a handle in the example shown, which is turnably supported in the post 27 and in the example shown unturnably applied on the lower end of a turning rod 84 that is coaxially turnably supported in the protective post, which turning rod extends through the whole protective post or at least until the coupling device 31. In a corresponding way, the upper maneuvering means 44 is preferably applied on the upper end 40 of the protective post 27. At the coupling devices 30, 31 a movement transmitting mechanism 65 is arranged to transmit the maneuvering movement of respective maneuvering means 44, 46 to a shifting movement of the locking means 57 in the appurtenant coupling device 31 between the locking position according to FIG. 2 and the releasing position according to FIG. 3. In the example shown, the movement transmitting mechanism consists of a link arm mechanism consisting of a link arm 66 and a push rod 67. The link arm 66 is unturnably connected with the turning rod 84 and the push rod 67 is in one of its ends jointly connected with the link arm and in its other end connected with a locking means in order to achieve a longitudinal displacement movement of the locking means, by means of the turning movement, against the action of a spring mechanism 68, e.g. a screw spring (compression spring) that strives to retain the locking means 57 in a locked position. By means of slot holes in the joint point, the push rod 67 and thus the locking bolt 57 may carry out a pure longitudinal displacement movement. Alternatively, the locking means may be pivoted.

The coupling device 31 is preferably permanently applied on the protective post 27, in the example shown by means of the grab hook 52 turning into a short arm 61 with a hole 62 in one of its ends. The hole is dimensioned and shaped to be pervaded by the protective post 37. A permanent attachment may be made either by means of a welded joint, screw joint or similar. Alternatively, the joint devices 47-50 and thus the protective rails 33, 34 are vertically adjustable along the protective posts. As disclosed in the figures, the grab hook 52 and the arms 61 are angled in such a way that the protective post 27 is in a displaced position relative to the scaffold post 6. Thus protective devices are enabled to be arranged in scaffolds with more than four scaffold posts, see FIG. 7.

Further, the protective rail 32 in the protective device is infinitely variably extendible, for example by every rail element 33, 34 being telescopically extendible and may for example consist of an outer tube 63 and one inner tube 64 telescopically insertible in the outer tube 63. More than two may occur in order to acquire a larger interval of change. By the ability to change the length, one and the same protective device may be used for different lengths of work platforms 7, i.e. different distances between scaffold posts 3, 6 and it also enables the gradual movement of one protective post 26, 27 at the time in the protective device as the scaffold is mounted or dismounted.

The use of the protective device according to FIGS. 1-7 at mounting of a scaffold will now be described.

As mentioned earlier, the mounting of the scaffold starts from below with the raising of a number of scaffold posts and firstly mounting of a staying scaffold element which may be mounted at a low height, on the whole by personnel on the ground. In the example according to FIG. 1, the scaffold rail 15 is mounted at four points between the two front scaffold posts 3, 6, after which transverse lying scaffold elements 71 suitably are connected at a low height, see FIG. 5, between the front scaffold posts 3, 6 on one side and the back scaffold posts 4, 5 on the other side. Thereafter, the first work platform 7 may be placed at a suitable height with not shown hooks that catch hold around the transverse scaffold elements. Depending on the height of the final scaffold, more sections are used for each scaffold post, where one starts with lower sections to gradually join further sections as the scaffold is mounted. The joining is preferably done in such a way that all the sections of the scaffold posts are arranged along one and the same longitudinal axis.

Before personnel enter the work platform 7, the protective device is mounted in such a way that the associated protective rail 32 is placed at a suitable protective height above the work platform. The mounting is preferably made by two persons, where the protective device may be mounted on the ground. For the purpose of transport, the protective posts 26, are suitably released from the protective rail 32 at the joint devices 47, 48, 49, 50, for example may those of the rail elements 33, 34, 35-57 be inserted in tube sockets and be lockable with a transversely extending pin in a hole. Alternatively, the joint device 47 may be divisible. In the storage and transport position, the protective device thus mainly constitutes a number of parallel lying tubes, according to the example shown four. The mounted protective device 1 is placed together with its two protective posts 26, 27 on the outside of those scaffold posts 3, 6, at which the protective posts shall be connected. This is done at such a height that, as mentioned above, the protective rail 32 provides an effective protection. Further, the coupling devices 28, 29, 30, 31 are shiftable to a releasing position, after which their coupling hooks 52 are brought to catch hold around the associated scaffold post. Then the closest accessible maneuvering means is activated, for example the lower maneuvering means 45, 46 for shifting to locked position. The activation takes place under the influence of the spring mechanism 68, which sees that the locked position is secured during the use of the protective device. In the example shown, the vertical position of the protective posts 26, 27 is secured, as mentioned above by some part in the shown example the lower coupling device rests against the closest permanent coupling means 14 in the scaffold posts (with the scaffold element 71 lying between). As the rail elements 33, 34 of the protective rail 32 are jointly connected with the protective posts in their ends and also are extendible, the mounting does not have to be done completely synchronously on both sides, but individually, where the rail elements due to their changeable length may be adapted to the current distance between the scaffold posts.

The protective device 1 may in its first protective position according to FIG. 1 either be mounted from ground level or from another safe working position, for example from a so-called sky lift. The protective device in the position shown brings a great safety for the personnel that work on the work platform 7 in order to continue the mounting of the scaffold. For example, further sections of scaffold posts may be joined, after which permanent scaffold rails 16 are mounted inside the protective rail 32 and a work platform 8 positioned above may be mounted.

Figure 4:
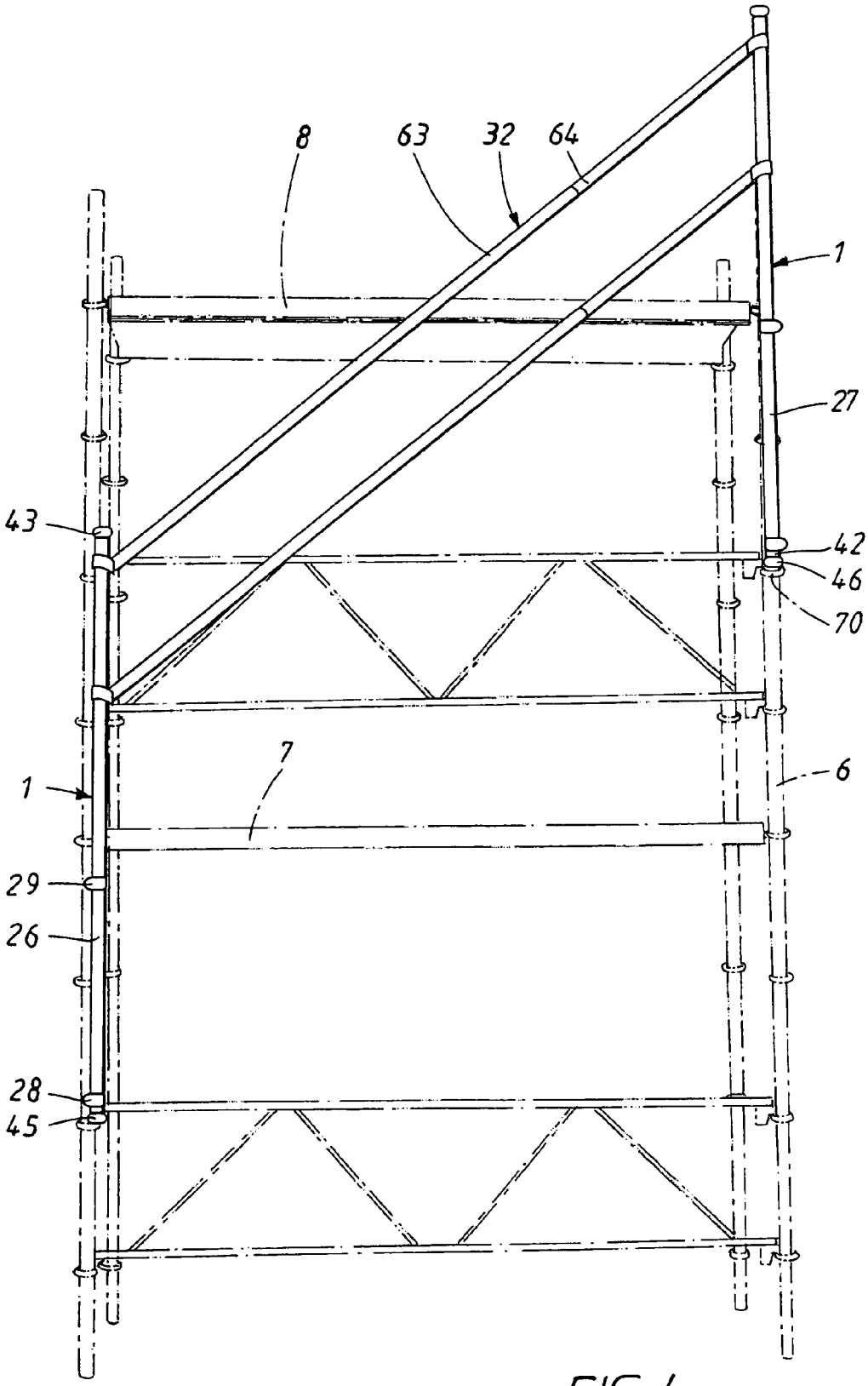
FIG. 4 shows the first embodiment of the protective device according to the invention in an intermediate position during movement to a higher protective position on the scaffold.

Before the scaffold is about to be mounted further above the uppermost building platform according to FIGS. 1 and 4, the protective device 1 according to the invention is moved further upwards. Thus one of the protective posts 27 is released by shifting (in the example turning) one of the maneuvering means 44, 46 in the ends of the protective post. A scaffold builder may thus suitably be present on the work platform 7 and activate the maneuvering means 44 for releasing, after which he lifts the protective post upwards along the scaffold post 6. This is possible as the rail elements 33, 34 are jointed in their mounting points and are telescopically extendible, as disclosed in FIG. 4. When the elevated end of the protective rail 32 has reached the desired height, the protective post is coupled to the scaffold post 6 and one of the maneuvering means 44, 46 is activated (in the example dropped), suitably the lower maneuvering means 46 for shifting the coupling devices 30, 31 to coupled or locked position. It is thus seen to that the protective post 27 acquires vertical support against another coupling means 70 in the scaffold post 6, see FIG. 4. The other side of the protective device 1 may then be moved upwards by releasing the left protective post 26 by means of, for example, the maneuvering means 43, after which for example a person standing at the left of the work platform 7 may lift the protective post 26 to the desired position, suitably with the protective rail 32 mainly horizontal after which the coupling devices 28, 29 are shifted to coupled position. It is conceivable that one single scaffold builder does this, since one protective post is handled a time.

Figure 5:
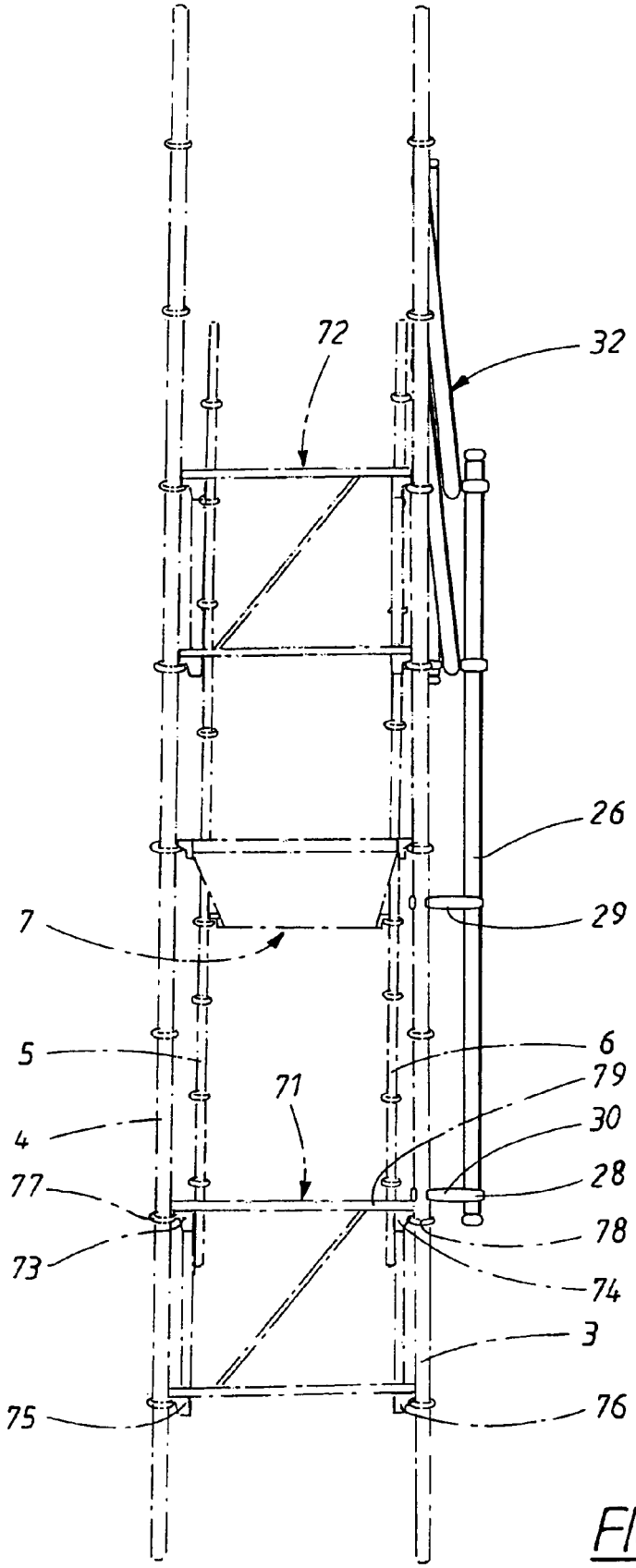
FIG. 5 shows an end view of the first embodiment of the protective device in the intermediate position.

FIG. 5 shows an end view of the scaffold with the protective device 1 according to the invention in a position according to FIG. 4. In this figure the transverse scaffold elements 71, 72 that form transverse scaffold rails are shown, which to a great extent also is a part of the supporting construction of the scaffold. The transverse scaffold rails are equipped with four coupling devices 73, 74, 75, 76, hooked into each permanent coupling means 77 on the scaffold post 3, 4. In a corresponding way, transverse rail elements are mounted between the two other scaffold posts 5, 6 if they form the far end of the scaffold. Shall it be built further in several modules sideways, such scaffold rails are not mounted, since they prevent free movements along the length of the scaffold. Thus the scaffold rails 71, 72 may be replaced by simple transverse scaffold tubes. From FIG. 5 it is evident that the protective posts 26 are placed at a certain distance from the scaffold posts at the same time as the protective rail 32 is arranged between the protective posts and the scaffold posts.

Figure 6:
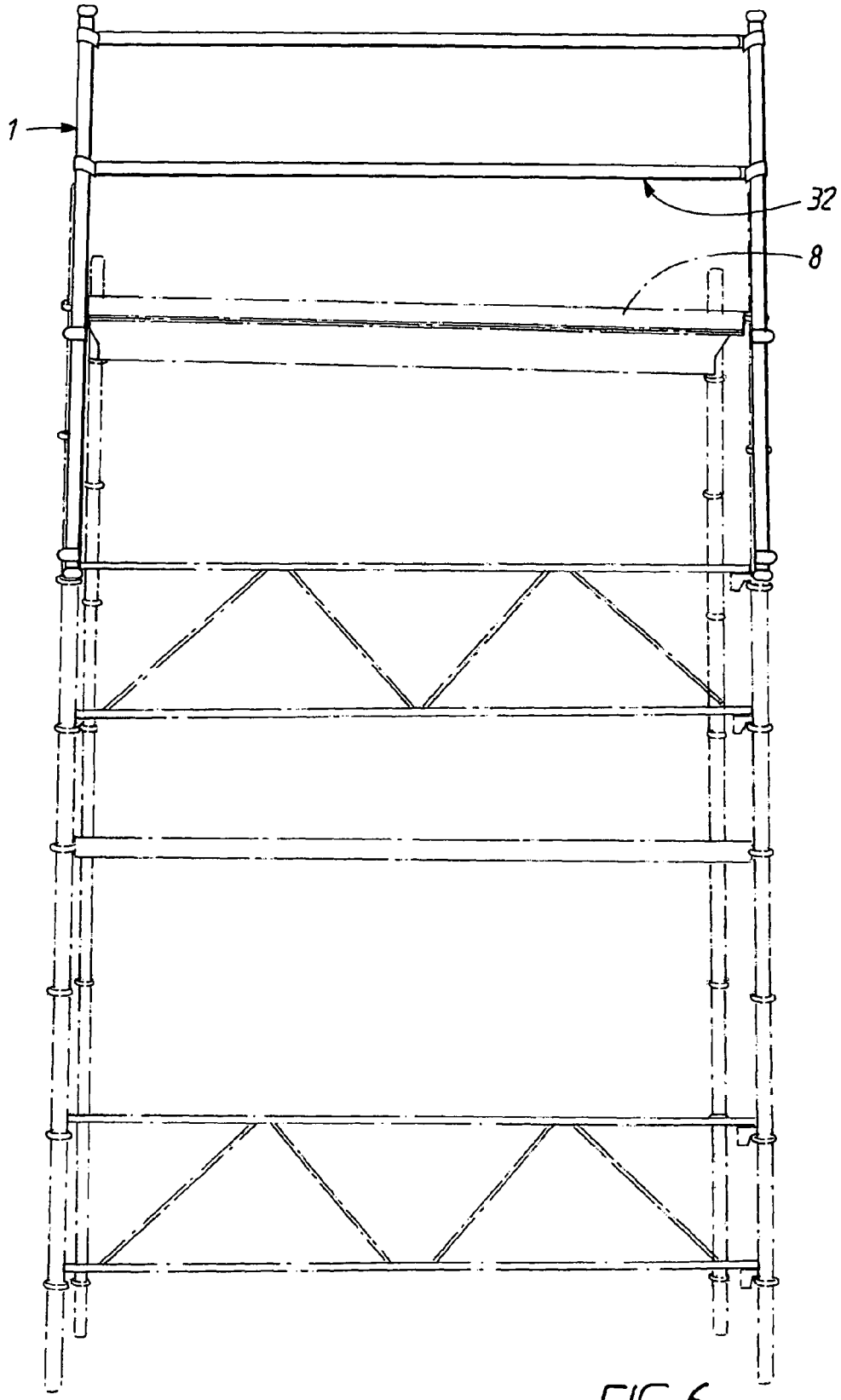
FIG. 6 shows the protective device in the higher protective position.

The protective device 1 is thus in a protective position according to FIG. 6 where scaffold builders may build the scaffold further standing on the platform 8 at a high degree of safety. Then further scaffold posts may be joined above the four scaffold posts that are shown and a permanent scaffold rail is mounted inside the protective rail of the protective device.

Figure 7:
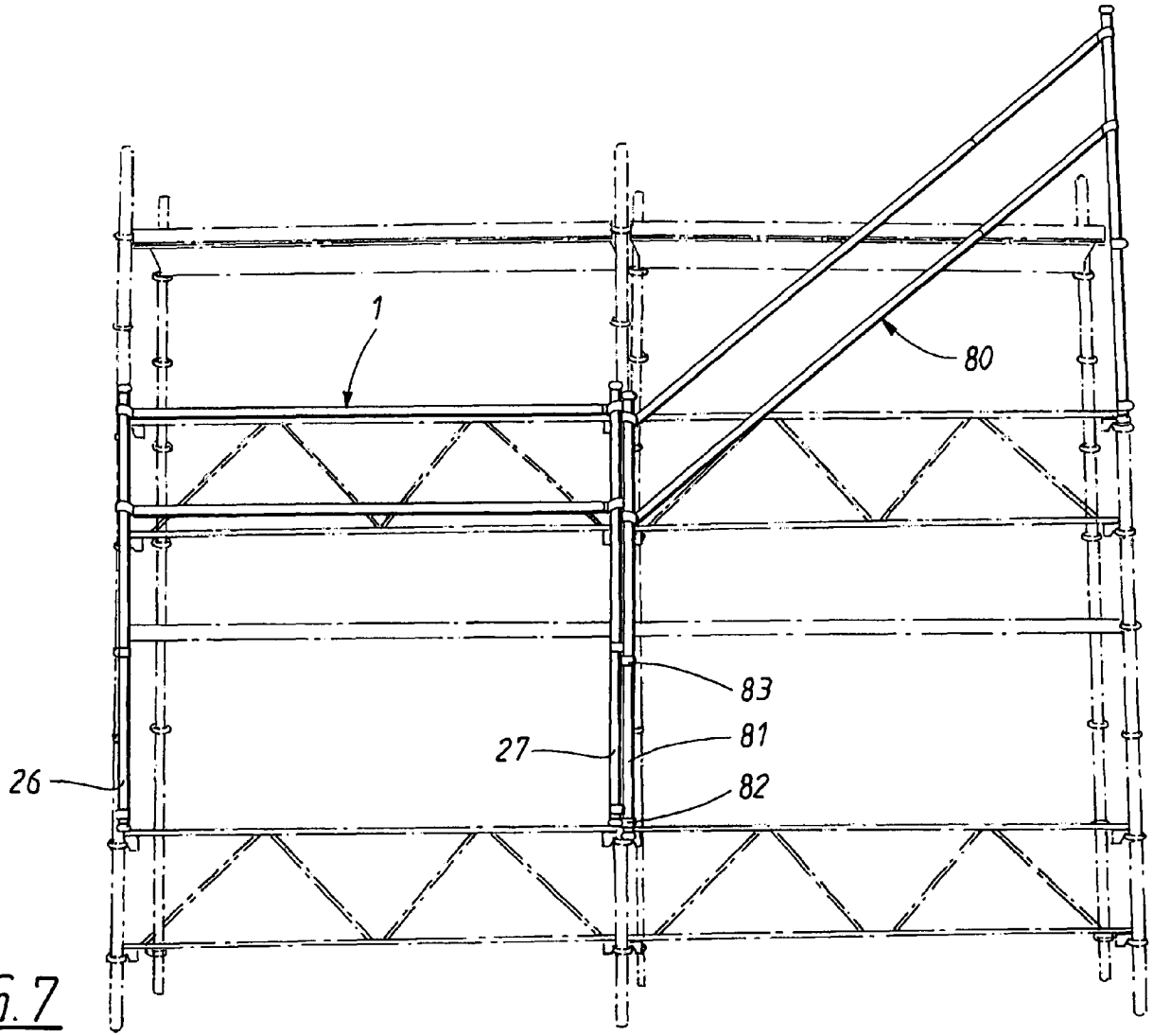
FIG. 7 shows an example of how two protective devices may be arranged on one and the same post, at double and multiple sections of scaffolds.

The reason for arranging the protective posts 26, 27 at certain distances from the scaffold posts is that they then may be sideways displaced relative to the scaffold posts, as described above with reference to FIGS. 2 and 3. Thus space is provided for further protective devices 80, of which one is shown in FIG. 7, where one further scaffold section is shown, where two scaffold posts are common with the first section. It is thus apparent that its left protective post 81 is provided space beside the right hand protective post 27 of the left hand protective device 1. Its coupling devices 82, 83 will not get into conflict with the coupling devices of the first protective device either, since it is seen to that its grab hooks are connected to the tube of the scaffold post axially displaced. Thus the grab hooks of one of the protective devices may rest above the grab hooks of the adjacent protective device and acquire vertical support in this way. In a corresponding way several protective devices may occur, according to the number of sections.

When the scaffold is mounted, the protective device may in principle remain in its uppermost position and either form a supplementary protection or possibly replace the uppermost protective rail.

When dismounting the scaffold, the procedure is in principle the same as described above, but in the reverse order as the different elements of the scaffold are dismounted starting from the top.

Figure 8:
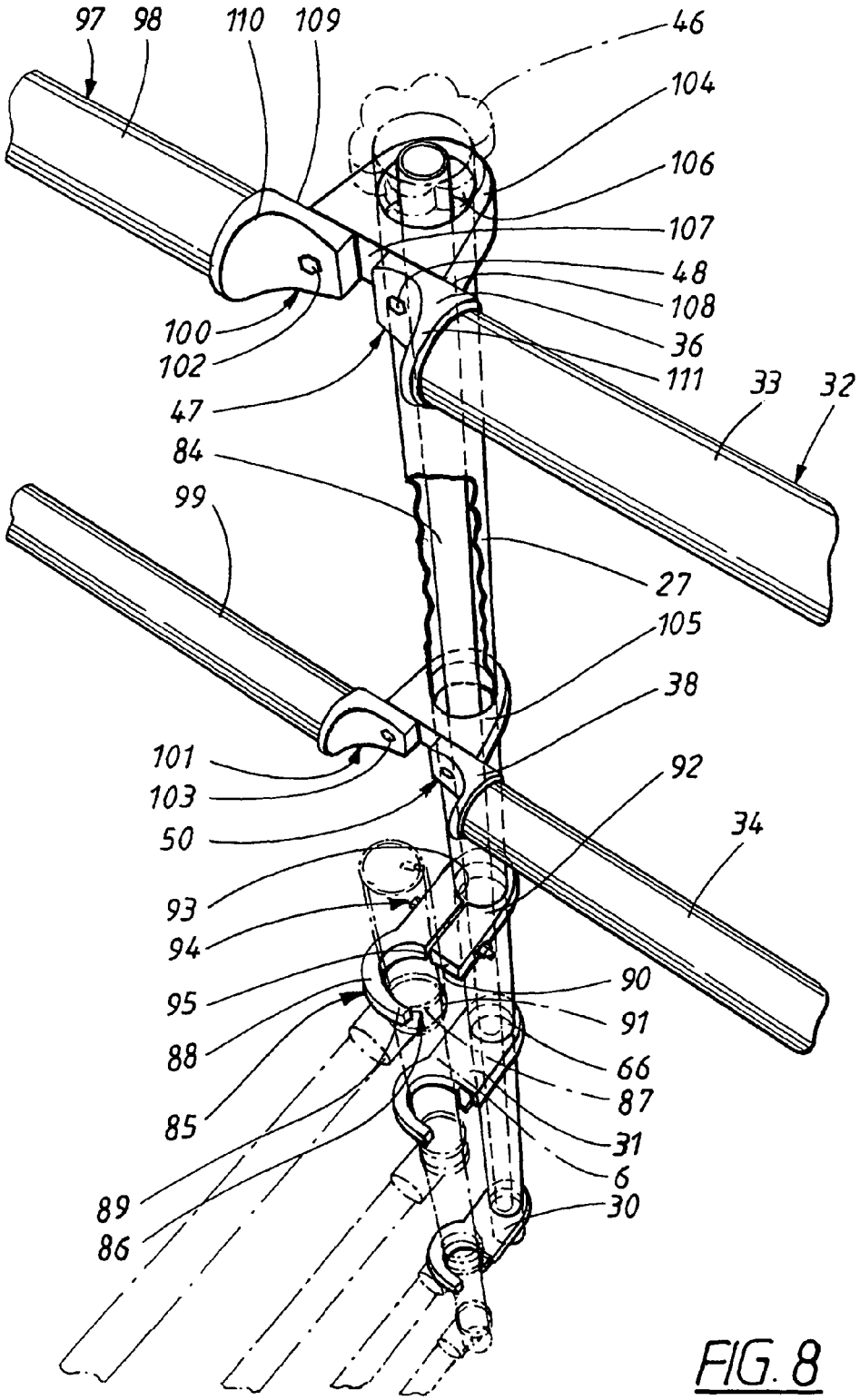
FIG. 8 shows, with a partly broken perspective view, an alternative embodiment of a protective post that forms a part of the protective device.

In the alternative embodiment according to FIG. 8, the protective device has, in principle, the same basic construction with protective posts 27, of which one is shown in the broken partial view, protective rail 32 and shiftable coupling devices 30, 31 on each protective post. In the upper end of the protective post the maneuvering means 46 is arranged well visible in the form of a handle or a wheel that is shaped to be easy to grip, in the example shown with a wave shaped profile. The handle is arranged in the end of the protective post and permanently applied on the end of the maneuvering rod 84 that is turnably supported in and runs inside the protective post concentrically with it at least down to the two shiftable coupling devices 30, 31. Here is also, however, a corresponding handle preferably arranged in the opposite end of the protective post, but is in the example hidden below the lower coupling device. Considering the rest of the construction and the function of the maneuvering means, the maneuvering rod and the shiftable coupling devices, reference is made to the description above with reference to, among other things, FIG. 2 and FIG. 3.

In the alternative embodiment according to FIG. 8 the coupling devices 30, 31 on the protective posts are supplemented with a separate supporting device 85, which is arranged to form a support against any firm, upward facing bearing surface in the scaffold, such as any of the existing coupling attachments for connecting horizontal elements with posts. For this purpose, the supporting device is equipped with a downwardly facing support surface that is intended to rest on an upwardly facing surface of the coupling attachment that forms a bearing surface for the supporting device. As to the rest, the supporting device 85 in the example shown has a main design that corresponds to the coupling devices 30, 31 with a grab hook 88, which end 89 forms a grab opening 91 against the connecting side 90 of the supporting device which grab opening 91 exceeds the outer diameter of the scaffold post 6. The scaffold 85 is equipped with a connecting part 92 on its connecting side with a pervading hole 93, through which the protective post 27 extends. The protective device 85 is equipped with a releasable locking device 94 in order to keep the supporting device locked to the protective post in use position, and to be released to enable axial movement along the protective post for adaptation of the vertical support to the vertical position of the current bearing surface in the scaffold. In the example shown, a locking device consists of a pervading clamping screw with a nut and a pervading slot 95 that divides the connecting part 92 and keeps the hole 93 open with a variable diameter in order to achieve a clamping and retaining function by means of at least friction locking. A friction locking is preferably supplemented with some form of shape locking, for example transverse grooves in the hole 93 and the mantel surface of the protective post. Other kind of shape locking is also conceivable, for example via a protruding flange from the protective post with a vertically extending row of locking holes. As any part of the connecting device 92 may be chosen to extend into one of the locking holes and may be extracted for being moved to another locking hole, the vertical position may be set. The supporting device 85 is positioned and dimensioned in such a way that the grab space 96 that is formed and the grab opening 91 end up in line with the corresponding parts of the coupling devices 30, 31 at the same time enabling the scaffold post 6 to extend through both coupling devices and supporting devices and that these may be brought sideways to grab position or out of grab position for mounting of the protective posts or dismounting of these for removal or vertical movement.

By means of the special supporting means 85, the supporting function of the coupling devices according to the fist embodiment may be taken over, leaving the coupling devices with the only function to retain the protective posts radially or sideways relative to the scaffold stands. Thus the protective device may easily be adapted to existing bearing surfaces in the scaffold and thus the flexibility of the protective device and its usefulness for different types of scaffolds increases.

The embodiment according to FIG. 8 also shows that it is possible to connect one additional further protective rail 97 which may be arranged at the same height as the protective rail 32, but is directed in the opposite direction in order to form a protective rail for the adjacent scaffold section. Thus a protective device consists of three parallel protective posts. The protective rail 97 also consists of two parallel rail elements 98, 99, which may be mounted to connecting devices which are common for the rail elements 33, 34 in the protective rail 32, but have, however, preferably separate joint devices 100, 101 with separate joint axes 102, 103. In the example shown, the connecting devices are made with an upper and a lower connecting console 104, 105, each one with a hole 106 through which the protective post extends. A joint is arranged between the protective post and the connecting consoles 104, 105, for example a welded joint or a screw joint. Each connecting console is further equipped with plane joint surfaces 107, which extend parallel to the longitudinal axis of the protective post and cooperates with the corresponding plane joint surfaces 108, 109 in each rail element 33, 98. The joint surfaces 108, 109 are a part of an end part 110, 111 which forms the end of the rail elements.

The invention is not limited to the embodiments described above and shown on the drawings, but may be varied within the scope of the appended claims. For example, it may in certain cases be sufficient with a coupling device on each protective post. If it thus is given a larger vertical extension, a coupling, that is torsionally rigid, is acquired anyway. Instead of special supporting devices for vertical support, the protective posts may be made to be extendible. Alternatively, a desired protective height of the protective rails may be chosen by these actions independent of the vertical positions of the coupling devices. In certain cases it is sufficient with a protective rail in the form of one single rail element. Alternatively, the rigid telescopic protective rails may be replaced with rewindable bands or wires, which are mounted to the protective posts. In principle, it is conceivable that the connection devices for the protective rail 32 are permanent, i.e. not joined, and that the rail elements are not extendible and adjusted in length for the distance between the scaffold stands 3, 6. For example, the protective device may permanently have the appearance of the left hand protective device in FIG. 7. An intermediate variant of this may alternatively be equipped with extendible but not jointed rail elements for adaptation to different distances between the scaffold posts. One further version may consists of a protective post with transverse permanent protective rails that are sideways protruding from the protective post.

The invention claimed is:

1. A device for providing personal protection while constructing a scaffold, the device comprising:

a first protective post and a second protective post, each having a first end and a second end, and provided for positioning adjacent upright posts of a scaffold;

at least one coupling device attached to each of said first protective post and said second protective post, said coupling devices being provided for coupling said protective posts to said upright posts of said scaffold;

maneuvering elements, when actuated, being operable to switch said coupling devices between a release position and a coupling position connecting said protective post with said upright posts of said scaffold, said maneuvering elements being positioned proximate said first and second ends of each of said first and second protective posts;

a motion transmitting element provided within each protective post, wherein said maneuvering elements of each protective post are applied to said motion transmitting element, and wherein a movement transmitting mechanism is arranged to transmit maneuvering movement from said motion transmitting element to said at least one coupling device, such that any of said maneuvering elements, when actuated, being operable to switch said at least one coupling device of each protective post between a release position and a coupling position;

at least one variable length rail extending between said first protective post and said second protective post, said at least one rail having a first end portion and a second end portion;

a first pivoting joint connecting said first end portion with said first protective post; and a second pivoting joint connecting said second end portion with said second protective post.

2. The device of claim 1, wherein each of said first and second protective posts includes two coupling devices attached thereto, wherein actuation of at least one of said maneuvering elements of each protective post causes said two coupling devices to switch from one of said coupling position and said release position to the other of said coupling position and said release position.

3. The device of claim 1, wherein said motion transmitting element includes a rod attached to said coupling device, wherein actuation of one of said maneuvering elements causes actuation of said rod which thereby causes at least one of said coupling devices to switch between said coupling position and said release position.

4. The device of claim 3, wherein at least one of said coupling devices includes a spring mechanisms attached to said rod.

5. The device of claim 1, wherein said at least one rail includes two rails.

6. The device of claim 1, wherein said coupling device comprises a grab hook that forms an open space that is suitable to receive said upright post of said scaffold, and wherein said coupling device is equipped with a locking element that is shiftable between a locking position and a release position.

7. The device of claim 6, wherein said locking element is a locking bolt, which is moveably mounted within said grab hook, and arranged to protrude from said grab hook in a locking position for providing a bearing surface against a mantle surface of said upright post.

8. The device according to claim 6, wherein said open space faces in a direction away from said at least one variable length rail.

9. The device of claim 6, wherein said coupling devices further comprise an arm that is arranged to connect said grab hook with said protective post, wherein said grab hook and said arm can be attached to said protective post at one of a plurality of angles relative to said variable length rail, such that said protective post is sideways displaced relative to the upright post of the scaffold in a direction towards said at least one variable length rail.

10. The device of claim 3, wherein said rod of each of said first and second protective posts are coaxially turnably supported within each of said protective posts.

11. The device of claim 10, wherein said movement transmitting mechanism comprises of a link arm and a push rod, wherein said link arm is unturnably connected to said rod, and wherein said push rod connects said link arm with a locking means of said couple device.

12. A method of providing personal protection while constructing a scaffold, the method comprising:

providing a scaffold safety device comprising:

a first protective post and a second protective post for positioning adjacent upright posts of a scaffold;

at least one coupling device attached to each of said first protective post and said second protective post, said coupling devices being provided for coupling said protective posts to said upright posts of said scaffold;

maneuvering elements, when actuated, being operable to switch said coupling devices between a release position and a coupling position connecting said protective posts with said upright posts of said scaffold, said maneuvering elements being positioned proximate said first and second ends of each of said first and second protective posts;

a motion transmitting element provided within each protective post, wherein said maneuvering elements of each protective post are applied to said motion transmitting element, and wherein a movement transmitting mechanism is arranged to transmit maneuvering movement from said motion transmitting element to said at least one coupling device, such that any of said maneuvering elements, when actuated, being operable to switch said at least one coupling device of each protective post between a release position and a coupling position;

at least one variable length rail extending between said first protective post and said second protective post, said at least one rail having a first end portion and a second end portion,;

a first pivoting joint connecting said first end portion with said first protective post; and a second pivoting joint connecting said second end portion with said second protective post;

actuating at least one of said maneuvering elements of said first protective post to said release position to release said first protective post from said respective upright post of said scaffold;

moving said first protective post to a second elevational position which causes said first and second portions of said at least one variable length rail to extend and pivot about said first and second posts via said pivoting joint; and actuating at least one of said maneuvering elements of said first protective post to said coupling position to couple said first protective post to said respective upright post of said scaffold at said second elevational position.

13. The method of claim 12, further comprising:

actuating at least one of said maneuvering elements of said second protective post to said release position to release said second protective post from said respective upright post of said scaffold;

moving said second protective post to said second elevational position which causes said first and second portions of said at least one rail to retract and pivot about said first and second posts via said pivoting joint; and actuating at least one of said maneuvering elements of said second protective post to said coupling position to couple said second protective post to said respective upright post of said scaffold at said second elevational position.

14. A scaffold system comprising a scaffold and a protective device, the system comprising:

a scaffold comprising:

a plurality of upright posts comprising a first upright post and a second upright post spaced apart from said first upright post, a plurality of cross beam elements extending between said first upright post and said second upright post, and a plurality of platforms extending between said first upright post and said second upright post; and a protective device detachably coupled to said upright posts of said scaffold, said protective device comprising:

a first protective post and a second protective post, each having a first end and a second end, and provided for positioning adjacent said first upright post and said second upright post, respectively, of said scaffold, at least one coupling device attached to each of said first protective post and said second protective post, said coupling devices being provided for coupling said protective posts to said upright posts of said scaffold;

maneuvering elements, when actuated, being operable to switch said coupling devices between a release position and a coupling position connecting said protective post with said upright posts of said scaffold, said maneuvering elements being positioned proximate said first and second ends of each of said first and second protective posts;

a motion transmitting element provided within each protective post, wherein said maneuvering elements of each protective post are applied to said motion transmitting element, and wherein a movement transmitting mechanism is arranged to transmit maneuvering movement from said motion transmitting element to said at least one coupling device, such that any of said maneuvering elements, when actuated, being operable to switch said at least one coupling device of each protective post between a release position and a coupling position; at least one variable length rail extending between said first protective post and said second protective post, said at least one rail having a first end portion and a second end portion;

a first pivoting joint connecting said first end portion with said first protective post; and a second pivoting joint connecting said second end portion with said second protective post.

15. The system of claim 14, wherein each of said first and second protective posts includes two coupling devices attached thereto, wherein actuation of at least one of said maneuvering elements of each of said first and second protective posts causes said two coupling devices to switch from one of said coupling position and said release position to the other of said coupling position and said release position.

* * * * *